US007959456B2

(12) United States Patent
Nagashima

(10) Patent No.: US 7,959,456 B2
(45) Date of Patent: Jun. 14, 2011

(54) WIRING CABLE CONNECTOR

(75) Inventor: Shinyu Nagashima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/876,279

(22) Filed: Sep. 7, 2010

(65) Prior Publication Data

US 2011/0065329 A1 Mar. 17, 2011

(30) Foreign Application Priority Data

Sep. 14, 2009 (JP) ..... 2009-211892
Sep. 14, 2009 (JP) ..... 2009-211900

(51) Int. Cl.
*H01R 12/24* (2006.01)

(52) U.S. Cl. ..... 439/499; 439/567

(58) Field of Classification Search ..... 439/660, 439/620.21, 578, 404, 494, 499, 352, 471, 439/467, 567
See application file for complete search history.

(56) References Cited

U.S. PATENT DOCUMENTS 3,214,713 A * 10/1965 Strobel ..... 439/418
4,194,805 A * 3/1980 Ayer et al. ..... 439/465
4,225,205 A * 9/1980 Sinclair et al. ..... 439/467
5,310,362 A * 5/1994 Bauerle et al. ..... 439/620.21
6,361,353 B1 3/2002 Saka et al.
7,044,772 B2 * 5/2006 McCreery et al. ..... 439/493
7,762,835 B2 * 7/2010 Peters et al. ..... 439/499

FOREIGN PATENT DOCUMENTS

JP 08-162198 6/1996

* cited by examiner

*Primary Examiner* — Neil Abrams
*Assistant Examiner* — Phuongchi T Nguyen
(74) *Attorney, Agent, or Firm* — Gerald E. Hespos; Michael J. Porco

(57) ABSTRACT

A connector (10) to be mounted in a metallic transmission case (C) has a base housing (20). Terminal fittings (40) have a wire connecting portion (41) and a terminal connecting portion (42) arranged in an L-shape. The terminal connecting portions (42) are inserted through the base housing (20) and the wire connecting portions (41) are arranged side by side on the base housing (20). A cover housing (30) is assembled with the base housing (20) to cover the wire connecting portions (41). Lock projections (22) and lock pieces (31) lock the cover housing (30) and the base housing (20) together. A wall (33) projects from the cover housing (30) toward the base housing (20) between adjacent wire connecting portions (41); and a groove (26) is provided in the base housing (20) at a position corresponding to the wall (33) and into which the wall (33) is press-fit.

9 Claims, 8 Drawing Sheets

WIRING CABLE CONNECTOR

BACKGROUND OF THE INVENTION

1. Field of the Invention

The invention relates to a connector.

2. Description of the Related Art

U.S. Pat. No. 6,631,353 discloses a connector with a base housing, a cover housing and terminal fittings arranged in the base housing. The terminal fittings include press-contact blades and wires are press-fit into the terminal fittings. As a result, the press-contact blades cut insulation coatings on the wires and electrically contact the cores of the wires. The wires are arranged side by side in the base housing, and the cover housing has a wall that partitions between the adjacent terminal fittings as the cover housing is assembled with the base housing. The cover housing has a lock piece that engages a projection on the base housing to lock the cover housing with the base housing.

The lock piece has a base end and a free end that is pivotable about the base end. The free end of the lock piece pivots while moving onto the projection and then resiliently restores after moving over the projection. Thus, clearances must be formed between the free end of the lock piece and the projection and between the wall and the base housing. Contaminants, such as iron powder, can enter into these clearances and can short circuit the terminal fittings.

Japanese Unexamined Patent Publication No. H08-162198 discloses a connector with L-shaped terminal fittings. Each terminal fitting has a leg to be connected with a board and a connecting portion to be connected with a mating terminal. The leg and the connecting portion are aligned to define an L shape. The connecting portion is press fit into a holding hole formed through the housing. On the other hand, the leg has an engaging hole that can receive an engaging projection on the housing. Engagement of the engaging projection with the engaging hole positions the leg with respect to the housing.

The engaging projection could disengage from the engaging hole, such as when an inadvertent force acts on the leg. Thus, a function of positioning the terminal fitting might be lost.

The invention was developed in view of the above problem and an object thereof is to increase an overall operability of the connector.

SUMMARY OF THE INVENTION

The invention relates to a connector to be mounted and fixed to a case. The connector has a base housing, a cover housing and terminal fittings. Each terminal fitting has a wire connecting portion to be connected with a wire and a terminal connecting portion to be connected with a mating terminal. The terminal connecting portions are inserted at least partly through the base housing and the wire connecting portions are arranged substantially side by side on the base housing. The cover housing is assembled with the base housing to substantially cover the wire connecting portions. At least one engaging portion is provided on the base housing and at least one lock is provided on the cover housing. The lock engages the engaging portion to lock the cover housing on the base housing. At least one wall is provided on one of the base housing and the cover housing to project toward the other housing. The wall is arranged between and/or along the adjacent wire connecting portions. At least one groove is provided in the other housing at a position corresponding to the wall. Thus, the wall is press-fit into the groove to prevent a clearance from being formed between the adjacent wire connecting portions.

Therefore, short-circuiting between the adjacent terminal fittings is prevented and overall operability of the connector is improved.

Each terminal fitting preferably is formed so that the wire connecting portion and the terminal connecting portion are connected to have a substantially L or bent shape.

The wall and the groove may include sliding-contact surfaces to be held in sliding contact with each other by press-fitting the wall into the groove. A base end of the wall may be cut out in a press-fitting direction to form a cutout, and the sliding-contact surfaces may be extended in the press-fitting direction by inserting an opening edge of the groove into the cutout. The extension of the sliding-contact surfaces in the press-fitting direction increases frictional resistance on the sliding-contact surfaces and therefore increases a fixing force between the cover housing and the base housing. Further, a creepage distance between the adjacent terminal fittings increases by extending the sliding-contact surfaces thereby further preventing a short-circuit.

The groove may be substantially in a center of the base housing with respect to an arrangement direction of the wire connecting portions. Accordingly, a molding error that may exist in the base housing will be distributed to the opposite sides of the groove and the housings can be positioned accurately with respect to each other. Thus, the cover housing can be assembled accurately with the base housing.

The cover housing may be separate from the base housing. Accordingly, the cover housing and the base housing can be handled separately. Thus, it is unnecessary, for example, to mount wires in the base housing before the terminal connecting portions are press-fit into the base housing.

At least one projection may project from the base housing and may be inserted into at least one recess or though hole formed in or through the wire connecting portion of the terminal fitting. Accordingly, the terminal fitting is held more securely.

At least one pressing portion may be provided at a position on the cover housing corresponding to the recess or through hole. The pressing portion presses a peripheral portion of the recess or through hole that receives the projection against the base housing.

The pressing portion may be folded to include a U-shaped rib extending substantially along the outer circumferential surface of the projection. The U-shaped rib enhances the strength at the folded part. The U-shaped rib is less likely to incline as compared with two straight ribs arranged side by side as the pressing portion.

The pressing portion may include an extension rib at an end of an opening side of the U-shaped rib. Accordingly, the strength of the rib can be enhanced further since the extension rib is connected with the end of the opening side of the U-shaped rib. Further, the extension rib presses the wire connecting portion firmly against the base housing.

The terminal connecting portion may be thicker than the wire connecting portion. Accordingly, the terminal fitting can be positioned more securely.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is identified by the numeral 10 in FIGS. 1 to 9. The connector 10 of this embodiment is mounted on a transmission case C of an automotive vehicle and is in an environment with machine oil that may contain iron or steel powder. The connector 10 is fixed to a conductive plate (e.g. iron, aluminum or steel) defining part of the transmission case C and is connected to a solenoid valve S in the transmission case C.

Figure 5:
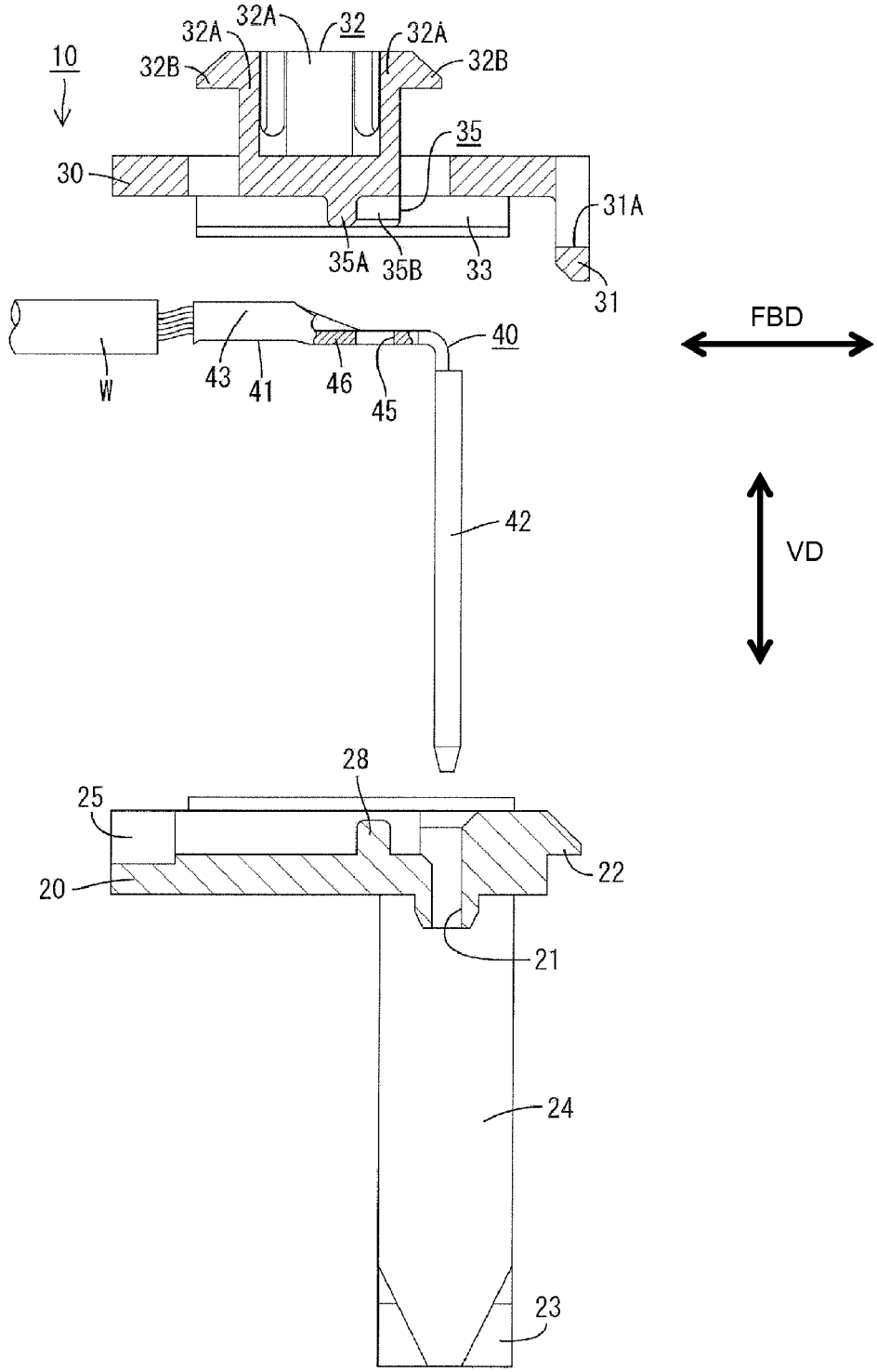
FIG. 5 is an exploded section showing a cover housing, a terminal fitting and a base housing in FIG. 3 in a vertically separated state.

As shown in FIG. 5, the connector 10 has a base housing 20, a cover housing 30 and terminal fittings 40 held between the housings 20 and 30. In the following description, vertical directions VD correspond to vertical directions of FIG. 1, forward and backward directions FBD correspond to vertical directions of FIG. 2 with the top of FIG. 2 referred to as a front, and width directions WD correspond to lateral directions of FIG. 2.

As shown in FIG. 5, each terminal fitting 40 has a wire connecting portion 41 to be connected with an end of a wire W and a terminal connecting portion 42 to be connected to the solenoid valve S. The terminal fitting 40 is formed by press-working a flat conductive metal plate and is bent to have a substantially L-shape in side view with the wire connecting portion 41 and the terminal connecting portion 42 aligned at a substantially right angle.

Figure 7:
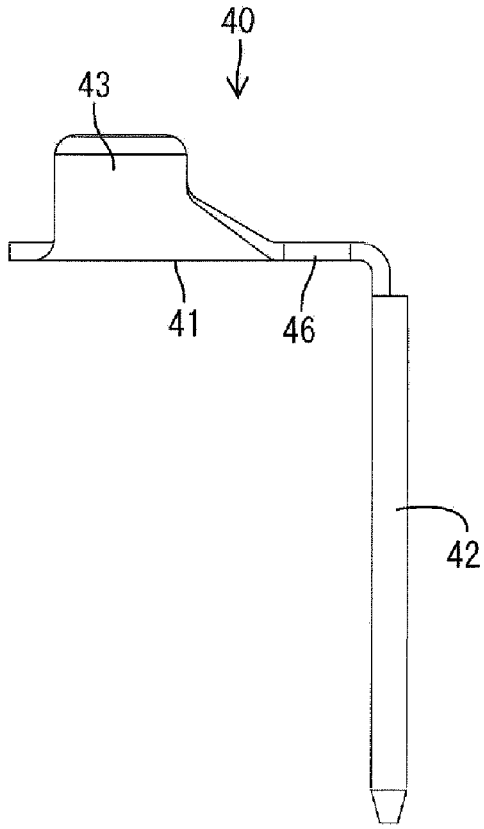
FIG. 7 is a side view of the terminal fitting.
Figure 8:
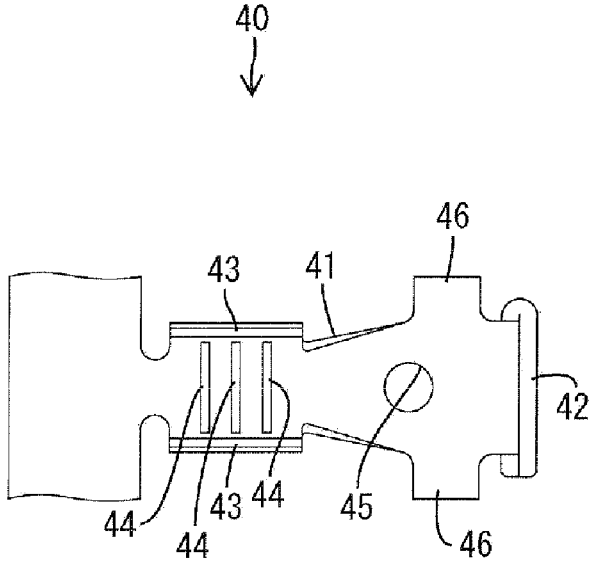
FIG. 8 is a plan view of the terminal fitting.
Figure 9:
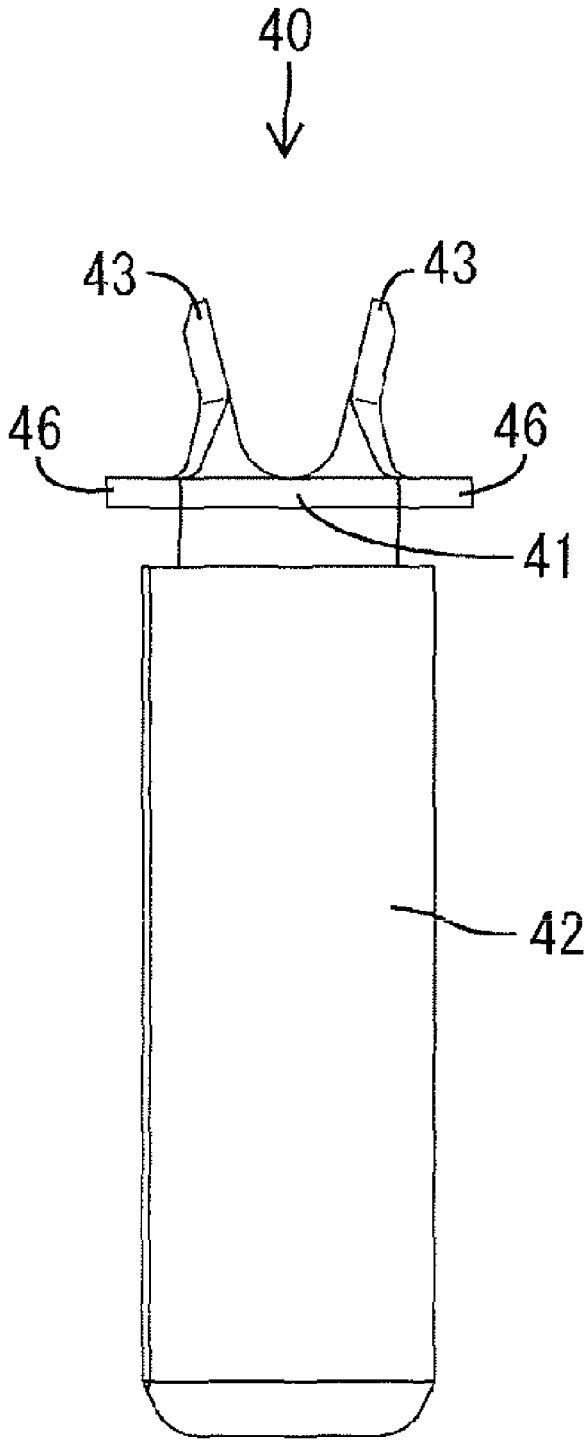
FIG. 9 is a front view of the terminal fitting.

The wire connecting portion 41 is long in forward and backward directions FBD, and two barrel pieces 43 project from opposite lateral sides of the wire connecting portion 41 as shown in FIGS. 7 to 9. The barrel pieces 43 are crimped, folded, bent or deformed into connection with a core of the wire W. Substantially side by side serrations are formed on crimping surfaces of the barrel pieces 43, as shown in FIG. 8 and a through hole 45 vertically penetrates the wire connecting portion 41 in proximity to the barrel pieces 43. Bulges 46 bulge out in the opposite width directions WD from the opposite lateral edges near the front of the terminal connecting portion 42.

On the other hand, the terminal connecting portion 42 is thicker than the wire connecting portion 41, and preferably is made at least twice as thick by closely folding back the metal plate at least once, as shown in FIG. 8, to form a tab particularly of substantially constant width, as shown in FIG. 9. A bottom end of the terminal connecting portion 42 is tapered toward the bottom to guide the terminal connecting portion 42 into a holding hole 21.

Figure 6:
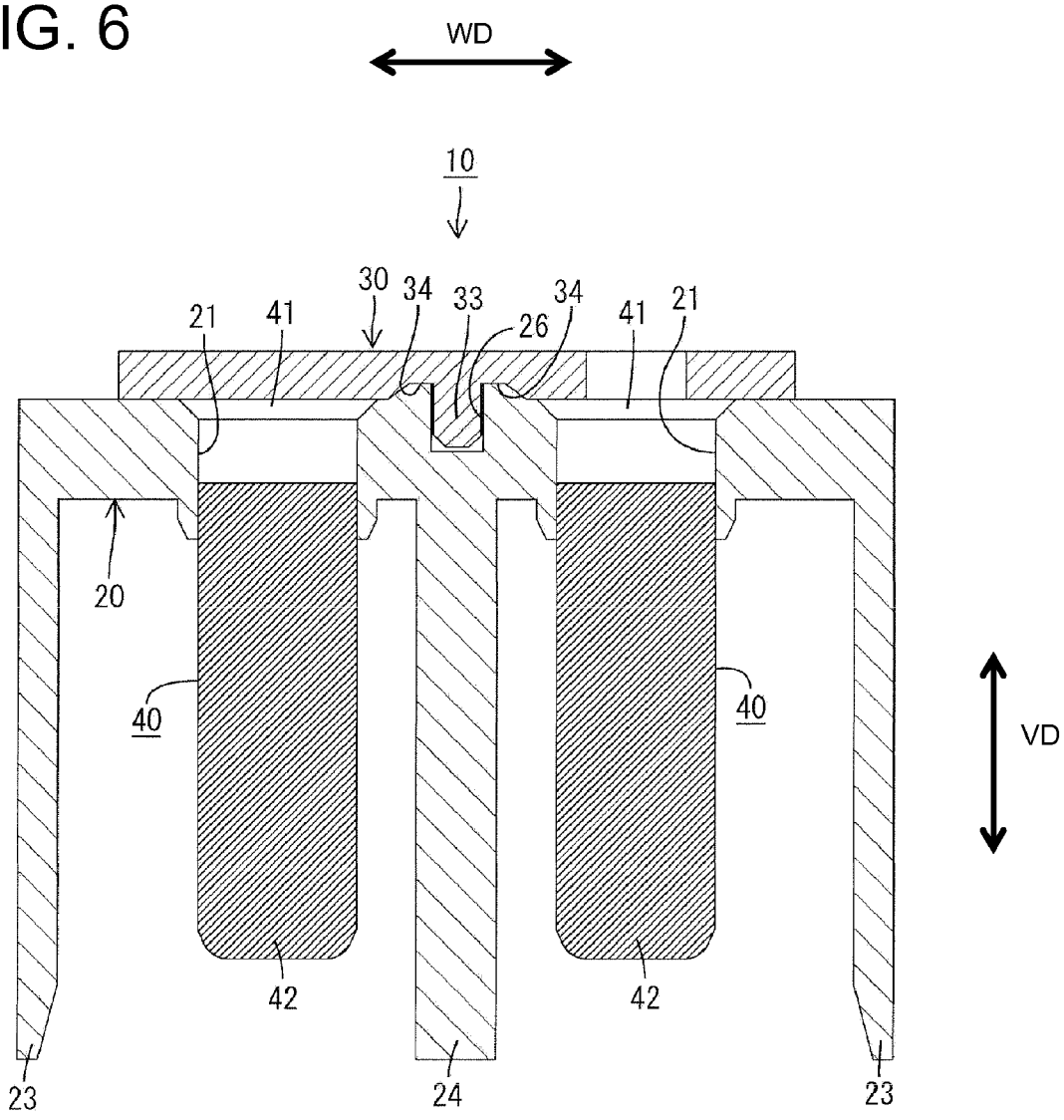
FIG. 6 is a section along B-B of FIG. 2.

The base housing 20 is made of synthetic resin and defines a substantially rectangular box with an open top. Two holding holes 21 vertically penetrate the base housing 20 and are dimensioned so that the terminal connecting portions 42 can be press-fit therein. Each holding hole 21 is wide and the two holding holes 21 are spaced from each other by a specified distance in the width direction WD. As shown in FIG. 6, the terminal connecting portions 42 are press-fit so that the opposite widthwise edges thereof are held in sliding contact with the opposite widthwise ends of the holding holes 21. The wire connecting portions 41 are arranged substantially side by side in the width direction WD on the upper surface of the base housing 20 when the terminal connecting portions 42 are press-fit to proper depths into the holding holes 21.

Figure 2:
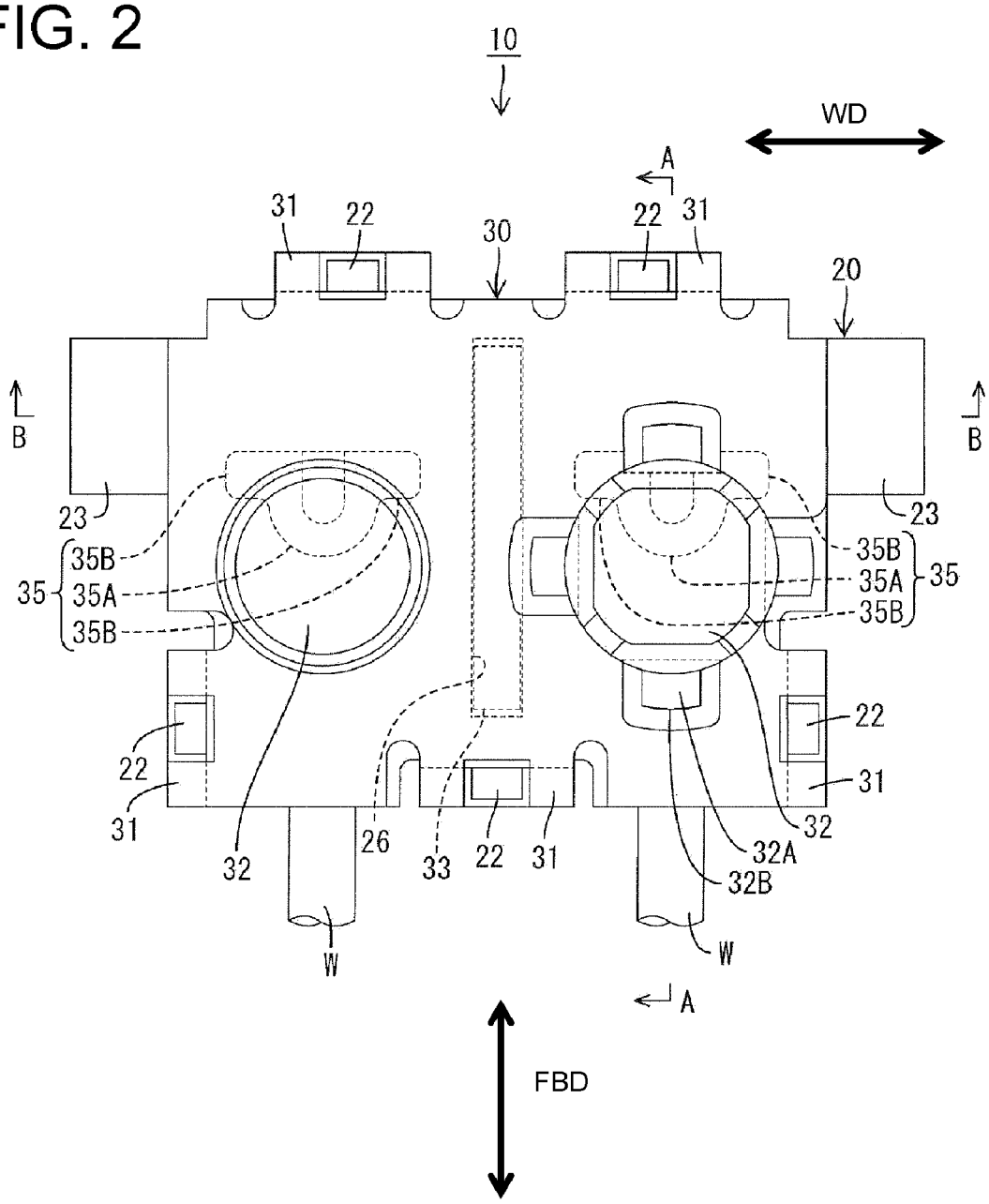
FIG. 2 is a plan view of the connector.

Lock projections 22 are provided on the outer surface of the base housing 20, as shown in FIG. 2. Specifically, two lock projections 22 are provided at a predetermined distance from each other in the width direction WD on the front surface of the base housing 20, one lock projection 22 is provided substantially in the widthwise center of the rear surface of the base housing 20, and one lock projection 22 is provided at a rear side of each of the opposite widthwise side surfaces of the base housing 20. Lock pieces 31 are engageable respectively the lock projections 22 to lock the cover housing 30 on the base housing 20.

Figure 1:
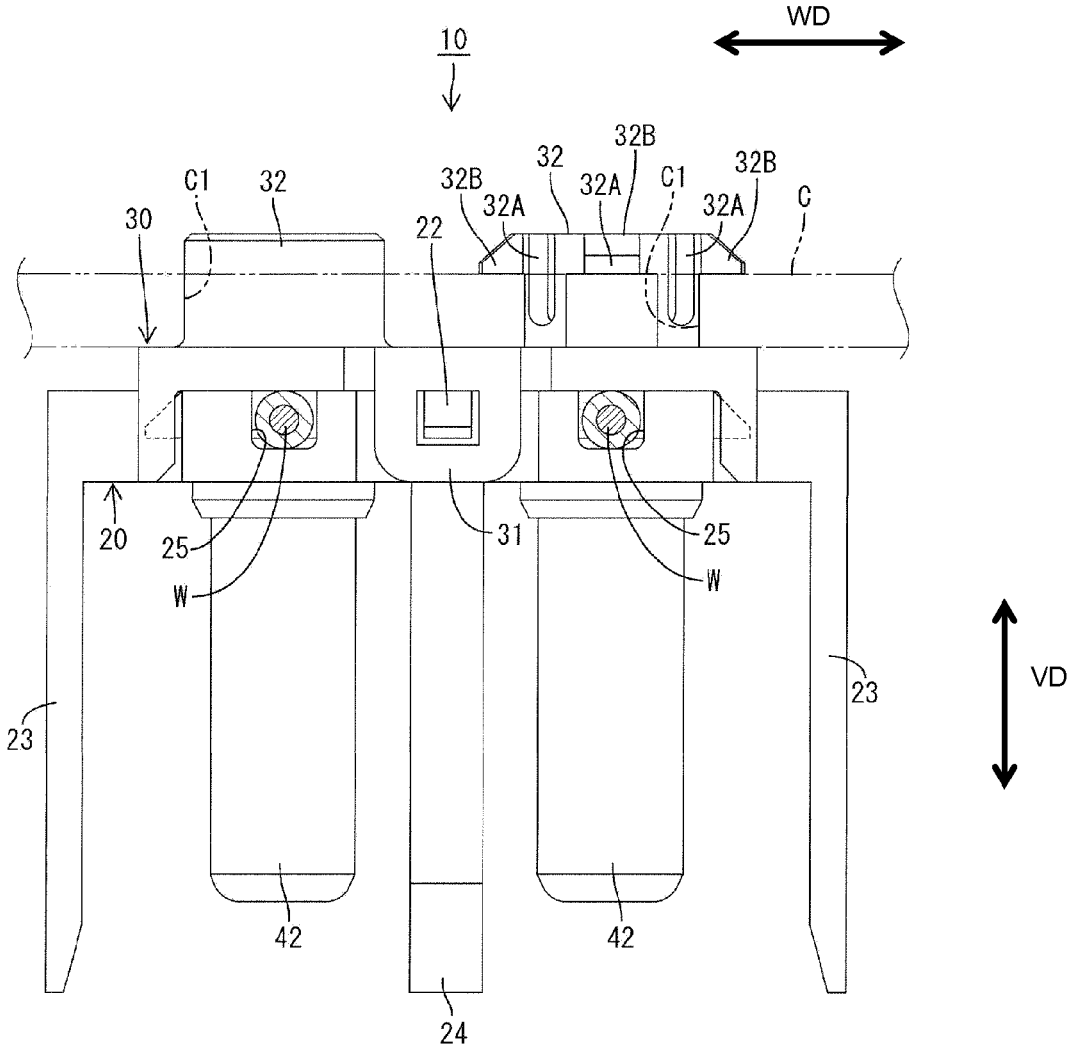
FIG. 1 is a front view of a connector according to the invention.

As shown in FIG. 1, two holding pieces 23 project in opposite width directions WD from the opposite side surfaces of the base housing 20 and then bend down at an angle. The holding pieces 23 are engageable with the solenoid valve S and can hold the connector 10 in a connected state with the solenoid valve S. A guide 24 is arranged between the terminal connecting portions 42 and extends down from the lower surface of the base housing 20 in a direction substantially parallel to the terminal connecting portions 42. The guide 24 partitions the terminal connecting portions 42 and positions the connector 10 with respect to the solenoid valve S.

Insertion grooves 25 are formed substantially symmetrically at opposite widthwise sides of the lock projection 22 on the rear surface of the base housing 20 and can receive the respective wires W. Insertion holes are formed by the insertion grooves 25 and the cover housing 30 for receiving the respective wires W.

The cover housing 30 is made e.g. of synthetic resin and includes two projections 32 that are insertable into respective mount holes C1 formed through the transmission case C, as shown in FIG. 1. The left projection 32 prevents rotation and the right projection 32 is for fixing. The projection 32 for fixing includes a plurality of fixing pieces 32A arranged at equal angular intervals as shown in FIG. 2. The fixing pieces 32A deform radially inwardly as the projection 32 is inserted into the mount hole C1 and then resiliently restore so that retaining projections 32B at the leading ends of the fixing pieces 32A engage an edge of the mount hole C1. Thus, the connector 10 is fixed in the transmission case C and is prevented from rotation when the projections 32 are fit into the corresponding mount holes C1.

Figure 3:
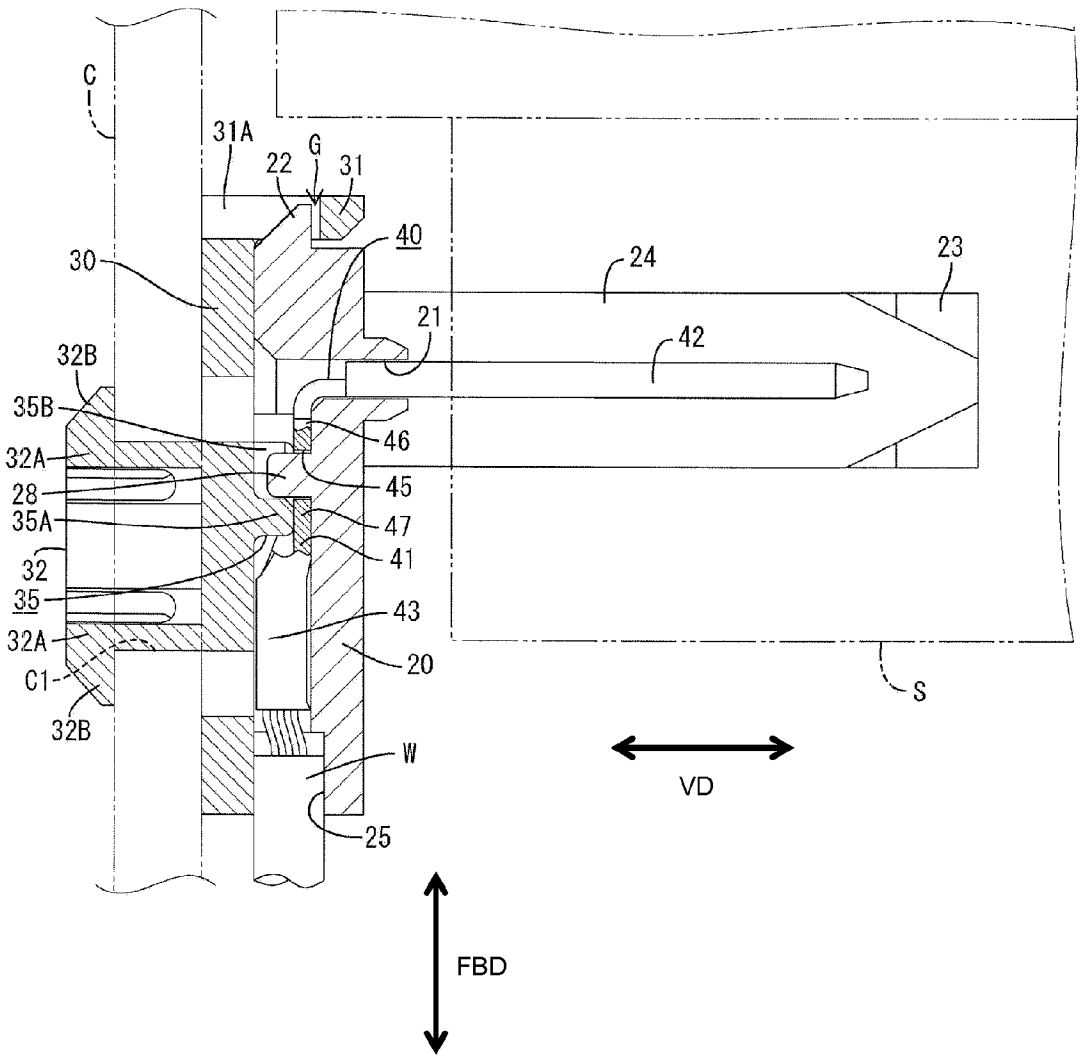
FIG. 3 is a section along A-A of FIG. 2.

Lock pieces 31 are formed on the outer surface of the cover housing 30 at positions corresponding to the lock projections 22 and are engageable with the respective lock projections 22. The lock pieces 31 are resiliently deformable, and lock holes 31A formed through the lock pieces 31 are fitted to the lock projections 22 so that the inner surfaces of the lock holes 31A engage locking surfaces of the lock projections 22, as shown in FIG. 3. The engagement of the lock projections 22 and the lock pieces 31 lock the cover housing 30 to the base housing 20 and cover the wire connecting portions 41.

The free bottom ends of the lock pieces 31 are displaced resiliently along pivot paths. As a result, clearances G inevitably are formed between the free ends of the lock pieces 31 and the lock projections 22 (see FIG. 3) when the free ends of the lock pieces 31 have restored resiliently after moving over the lock projections 22. Thus, a locking structure composed entirely of the lock pieces 31 and the lock projections 22 would permit the cover housing 30 and the base housing 20 to shake with respect to each other due to the clearances G. Further, a large amount of iron powder mixed with machine oil is present in the transmission case C, and the iron powder can enter the connector 10 and cause short-circuiting of the adjacent terminal fittings 40.

Accordingly, a wall 33 projects down from the lower surface of the cover housing 30 and can be press fit into a groove 26 in the upper surface of the base housing 20, as shown in FIG. 6. The wall 33 and the groove 26 have sliding-contact surfaces that are held in sliding contact with each other. More particularly, the wall 33 and the groove 26 are held press-fitted by the sliding contact of the sliding-contact surfaces. Thus, the cover housing 30 is fixed with respect to the base housing 20 and cannot shake. Therefore, even if iron powder enters the interior of the connector 10, the adjacent wire connecting portions 41 are partitioned so that the adjacent terminal fittings 40 are not short-circuited.

As shown in FIG. 1, the wall 33 has a substantially rectangular shape long in forward and backward directions FBD and extends along the wire connecting portions 41 at a position between the adjacent wire connecting portions 41. Thus, the press-fit parts of the wall 33 and the groove 26 prevent short-circuiting of the adjacent terminal fittings 40 of the adjacent wire connecting portions 41 even if iron powder enters the interior of the connector 10. Further, a creepage distance between the adjacent wire connecting portions 41 is extended by as much as the slide-contact surfaces of the groove 26 as compared with the case where a flat surface is formed between the adjacent wire connecting portions 41 so that a short-circuit preventing effect is improved.

Cutouts 34 are formed at the opposite widthwise sides of the wall 33 at the base end of the wall 33 of the cover housing 30 as shown in FIG. 6. An opening edge of the groove 26 projects in a press-fitting direction and can fit into the cutouts 34. Thus, the sliding-contact surfaces along which the wall 33 and the groove 26 are held in sliding contact are increased in the press-fitting direction by the cutouts 34, and frictional forces produced on the sliding-contact surfaces also increase. Therefore, the cover housing 30 and the base housing 20 are fixed with an increased force.

The disposition of the groove 26 and the wall 33 substantially in the widthwise center of the base housing 20 and the cover housing 30 respectively improves assembling accuracy of the cover housing 30 and the base housing 20. In other words, any molding errors that may exist can be distributed at the opposite sides of the press-fit parts of the groove 26 and the wall 33. Thus, position shifts of the cover housing 30 and the base housing 20 is suppressed to a minimum and the housings can be assembled accurately.

Projections 28 project up from upper surface of the base housing 20 and are received in the through holes 45 of the wire connecting portions 41 and hence position the terminal fittings 40 with respect to the base housing 20. Diameters of the projections 28 substantially equal diameters of the through holes 45. Thus, the terminal fittings 40 are positioned with respect to the base housing 20 at two positions, i.e. at the holding holes 21 and the projections 28.

Pressing portions 35 are formed on the lower surface of the cover housing 30 and press peripheral edge areas 47 near the through holes 45 against the upper surface of the base housing 20. As shown in FIG. 2, each pressing portion 35 includes a forwardly open U-shaped rib 35A and two extension ribs 35B that extend in opposite width directions from the opposite ends of an opening of the U-shaped rib 35A. The U-shaped rib 35A extends along the outer circumferential surface of the projection 28, and the extension ribs 35B are connected at substantially right angles to the U-shaped rib 35A to prevent the U-shaped rib 35A from inclining and to enhance strength of the U-shaped rib 35A.

As shown in FIG. 3, each U-shaped rib 35A is formed to press the peripheral edge portion 47 of the through hole 45 against the base housing 20. The leading ends of the projections 28 are not in contact with the lower surface of the cover housing 30 and the two housings 20, 30 are locked together when the leading ends of the U-shaped ribs 35A are pressing the peripheral edge portions 47 of the through holes 45. Thus, the through holes 45 cannot disengage from the projections 28. Further, the extension ribs 35B press the bulges 46 of the wire connecting portions 41 firmly against the upper surface of the base housing 20 as compared with the case where the wire connecting portions 41 are pressed only by the U-shaped ribs 35A. Therefore, the terminal fittings 40 are held positioned with respect to the base housing 20.

Upon assembling the connector 10, the barrel pieces 43 are crimped, bent, folded or deformed into connection with the cores exposed at the ends of the wires W. At this time, the two housings 20, 30 are separate members. Thus, the wires W need not be inserted into the base housing 20 beforehand and the wires W with the terminal fittings 40 can be mounted into the base housing 20 after the terminal fittings 40 are connected to the ends of the wires W.

The terminal connecting portions 42 of the terminal fittings 40 then are press-fit into the holding holes 21 from above the base housing 20 and along the vertical direction VD. The terminal connecting portions 42 are press-fit to proper depths by the sliding contact of the opposite widthwise sides thereof with the opposite widthwise sides of the holding holes 21. Simultaneously, the projections 28 are fit into the through holes 45 of the wire connecting portions 41. In this way, the terminal fittings 40 are positioned at two positions by the holding holes 21 and the projections 28. Further, since the terminal fittings 40 are assembled by being press-fitted into the base housing 20, it is not necessary to mold the base housing 20 using the terminal fittings 40 as inserts. Therefore, a molding die (not shown) can be simplified and a molding process can be simplified.

The cover housing 30 next is assembled with the base housing 20. Thus, the lock pieces 31 on the outer surface of the cover housing 30 deform resiliently to move onto the lock projections 22, and then resiliently restore after moving over the lock projections 22. Accordingly, the lock projections 22 enter the lock holes 31A so that the locking surfaces of the lock projections 22 engage the inner peripheral surfaces of the lock holes 31A are engaged to lock the cover housing 30 on the base housing 20. Thus, the wire connecting portions 41 are held between the base housing 20 and the cover housing 30 and the wires W are drawn out backward from the insertion grooves 25.

At this time, the wall 33 is press-fitted into the groove 26, as shown in FIG. 6, to prevent the cover housing 30 and the base housing 20 from shaking with respect to each other. Further, the adjacent wire connecting portions 41 are partitioned by the press-fitted parts of the wall 33 and the groove 26 to prevent conductive powder mixed in oil from entering between the adjacent wire connecting portions 41 to short-circuit them. Furthermore, the area of the sliding-contact surfaces is increased by the cutouts 34 and frictional resistance produced on the sliding contact surfaces accordingly increases. Thus, the cover housing 30 is fixed more firmly to the base housing 20. As the area of the sliding-contact surfaces increases, the creepage distance between the adjacent wire connecting portions 41 increases to improve the short-circuit preventing effect.

Figure 4:
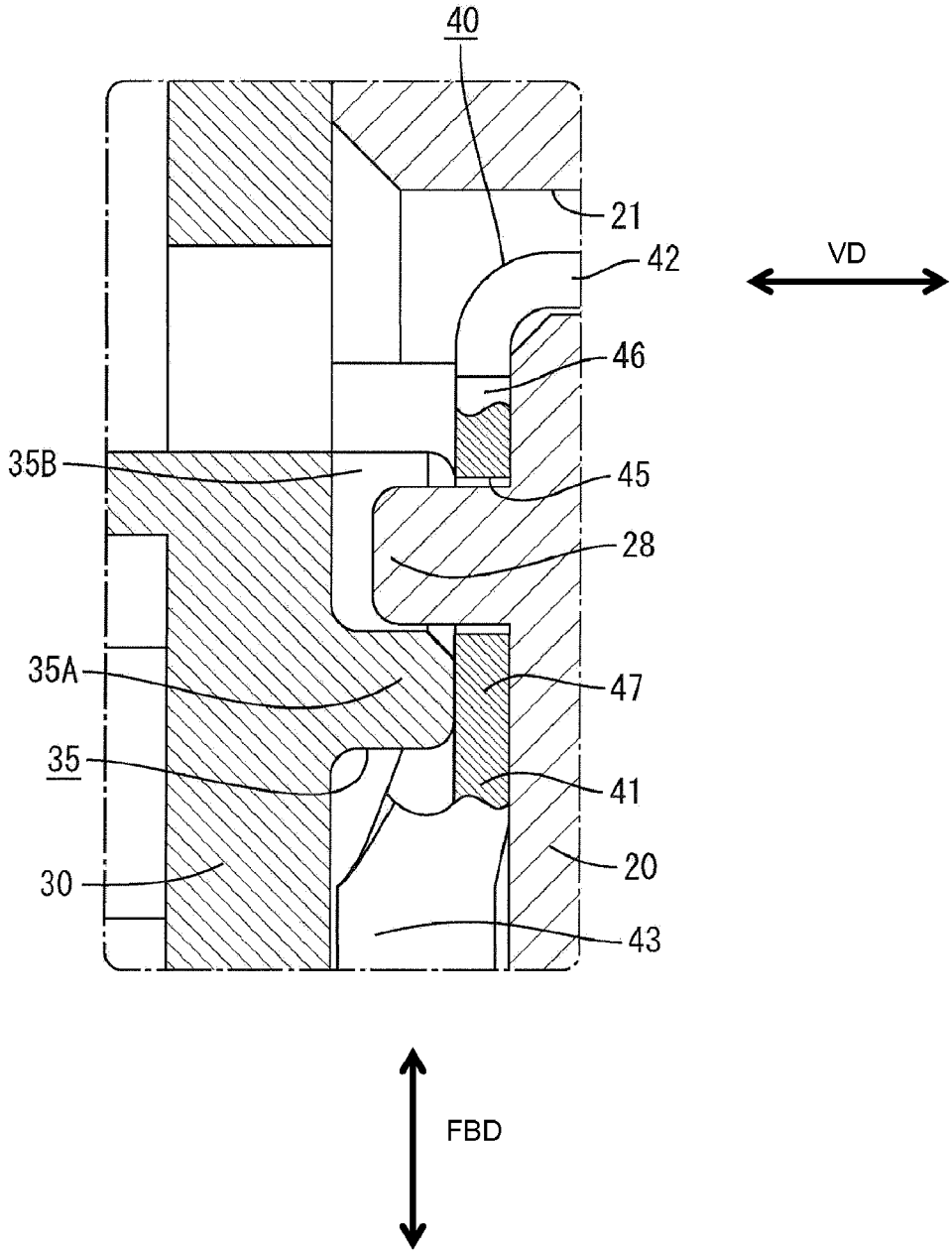
FIG. 4 is an enlarged section showing an essential part of FIG. 3.

As shown in FIG. 4, the U-shaped ribs 35A press the peripheral edge portions 47 of the through holes 45 engaged with the projections 28 against the base housing 20 and the extension ribs 35B press the bulges 46 against the base housing 20 so that the through holes 45 cannot disengage from the projections 28. Accordingly, the terminal fittings 40 are held at two positions, i.e. at the holding holes 21 and the projections 28. The extension ribs 35B reinforce the U-shaped ribs 35A so that the U-shaped ribs 35A are damaged, for example, by inclining. Further, the groove 26 is substantially in the widthwise center of the base housing 20 and the wall 33 is substantially in the widthwise center of the cover housing 30. Thus, the cover housing 30 and the base housing 20 can be positioned with respect to each other by press-fitting the wall 33 into the groove 26 so that the cover housing 30 can be assembled accurately assembled with the base housing 20.

As described above, a press-fitting structure comprising the groove 26 and the wall 33 eliminates shaking of the housings 20, 30 and prevents short-circuiting of the terminal fittings 40. Further, the cutouts 34 are formed in the cover housing 30 and the opening edge portion of the groove 26 is inserted into these cutouts 34. Thus, the area of the sliding-contact surfaces increases to increase frictional resistance so that a fixing force of the two housings 20, 30 is increased. Furthermore, the short-circuit preventing effect of the two terminal fittings 40 is improved by extending the creepage distance between the adjacent wire connecting portions 41. Further, the press-fitted parts of the groove 26 and the wall 33 are substantially in the widthwise centers of both housings 20, 30 so that the housings 20, 30 can be positioned accurately and assembled.

Upon mounting the terminal fittings 40 into the base housing 20, the terminal connecting portions 42 are press-fit into the holding holes 21 and the through holes 45 are fit to the projections 28 to have the peripheral edges 47 thereof pressed against the base housing 20 by the U-shaped ribs 35A and have the bulges 46 pressed against the base housing 20 by the extension ribs 35B. Thus, the wire connecting portions 41 are positioned and held in the base housing 20. The cover housing 30 is separate from the base housing 20. Therefore, the terminal fittings 40 can be mounted into the base housing 20 after the terminal fittings 40 are crimped and connected to the ends of the wires W to facilitate an operation of assembling the connector 10 is facilitated.

The invention is not limited to the above described and illustrated embodiment. For example, the following embodiments are also included in the technical scope of the present invention.

The base housing 20 is formed with the groove 26 and the cover housing 30 is formed with the wall 33 in the above embodiment. However, the base housing 20 may be formed with a wall and the cover housing 30 may be formed with a groove.

The base housing 20 is formed with the lock projections 22 and the cover housing 30 is formed with the lock pieces 31 in the above embodiment. However, the base housing 20 may be formed with lock pieces and the cover housing 30 may be formed with lock projections according to the invention.

Two terminal fittings 40 are arranged in the base housing 20 in the above embodiment. However, other numbers of terminal fittings 40 may be provided.

Two cutouts 34 are formed in the cover housing 30 in the above embodiment. However, one cutout 34 may be formed or no cutout 34 may be formed.

The groove 26 is in the widthwise center of the base housing 20 in the above embodiment. However, grooves may be at the opposite widthwise sides of each terminal fitting 40 or may be between the terminal fittings 40 and the holding pieces 23 according to the present invention.

Although the cover housing 30 and the base housing 20 are separate members in the above embodiment, the cover housing 30 may be integrally hinged to the base housing 20 according to the present invention.

Each pressing portion 35 includes the U-shaped rib 35A and the extension ribs 35B in the above embodiment, but it may have a cylindrical shape.

What is claimed is:

1. A connector to be mounted and fixed in a case, comprising:

a base housing having at least one engaging portion;

at least one terminal fitting having a wire connecting portion to be connected with a wire and a terminal connecting portion to be connected with a mating terminal, the terminal connecting portion being press-fit through the base housing, at least one hole formed in the wire connecting portion;

a cover housing assembled with the base housing and substantially covering the wire connecting portion, at least one lock provided on the cover housing and engageable with the engaging portion to lock the cover housing in an assembled state with the base housing; and at least one projection projecting from the base housing and being inserted into the hole in the wire connecting portion.

2. The connector of claim 1, wherein the terminal connecting portion is thicker than the wire connecting portion.

3. The connector of claim 1, further comprising at least one pressing portion provided at a position on the cover housing substantially adjacent the hole, the pressing portion being configured to press the wire connecting portion against the base housing.

4. The connector of claim 3, wherein the pressing portion has a U-shaped rib extending substantially along an outer peripheral surface of the projection.

5. The connector of claim 4, wherein the pressing portion includes an extension rib formed at an end of an opening side of the U-shaped rib.

6. A connector to be mounted and fixed in or to a case, comprising:

a base housing with at least one engaging portion, at least one groove and projections on opposite sides of the groove;

at least two terminal fittings, each terminal fitting having a wire connecting portion to be connected with a wire and a terminal connecting portion to be connected with a mating terminal, the terminal connecting portions being at least partly inserted through the base housing and the wire connecting portions being arranged substantially side by side on the base housing on opposite sides of the groove; and a cover housing assembled with the base housing and substantially covering the wire connecting portions, at least one lock provided on the cover housing and engageable with the engaging portion to lock the cover housing on the base housing, at least one wall projecting from the cover housing and being press-fit in the groove, the cover housing includes cutouts adjacent a base end of the wall, the projections of the base housing being inserted in the cutouts with surfaces of the projections and the cutouts being in sliding contact when the wall is press-fit into the groove.

7. The connector of claim 6, wherein at least one hole is formed through the wire connecting portion of each of the terminal fittings, at least one projection projecting from the base housing and being inserted into the through hole in the wire connecting portion.

8. The connector of claim 7, further comprising at least one pressing portion provided at a position on the cover housing substantially adjacent the through hole, the pressing portion being configured to press the wire connecting portion against the base housing.

9. The connector of claim 8, wherein the pressing portion has a substantially U-shape and extends at least partly around an outer peripheral surface of the projection.

* * * * *